US006591744B2

(12) United States Patent
Peek

(10) Patent No.: US 6,591,744 B2
(45) Date of Patent: Jul. 15, 2003

(54) WHEELED SQUEEGEE FOR FIRE HOSE

(76) Inventor: David Peek, 110 Puritan, Highland, MI (US) 48203

( * ) Notice: Subject to any disclaimer, the term of this patent is extended or adjusted under 35 U.S.C. 154(b) by 0 days.

(21) Appl. No.: 10/152,863

(22) Filed: May 22, 2002

(65) Prior Publication Data

US 2002/0185017 A1 Dec. 12, 2002

Related U.S. Application Data

(60) Provisional application No. 60/296,967, filed on Jun. 8, 2001.

(51) Int. Cl.[7] ..... B30B 3/04

(52) U.S. Cl. ..... 100/171; 100/176

(58) Field of Search ..... 100/168, 169, 100/171, 163 R, 76, 176; 137/355.26, 355.27; 242/532.6; 492/13

(56) References Cited

U.S. PATENT DOCUMENTS

| | | | | | |
|---|---|---|---|---|---|
| 1,373,680 | A | * | 4/1921 | Stanaland | 100/172 |
| 3,340,131 | A | * | 9/1967 | Leibow | 156/579 |
| 3,601,038 | A | * | 8/1971 | Hayes | 100/100 |
| 3,866,532 | A | * | 2/1975 | Ogden, Jr. | 100/171 |
| H1520 | H | * | 3/1996 | Hannula | 100/171 |
| 5,957,400 | A | * | 9/1999 | Brannen | 242/391 |

OTHER PUBLICATIONS

Lindermeir et al. (portable transporting device for winding material), Mar. 7, 2002, US 2002/0027178A1.*

* cited by examiner

*Primary Examiner*—Allen Ostrager
*Assistant Examiner*—Jimmy T Nguyen
(74) *Attorney, Agent, or Firm*—Gifford, Krass, Groh, Sprinkle, Anderson & Citkowski, P.C.

(57) ABSTRACT

A device for evacuating liquid from a collapsible hose. An elongated frame includes a pair of spaced apart wheels rotatably secured about an axis situated at an end of the frame. A first cylindrical member is mounted about the axis between the pair of spaced apart wheels. A second cylindrical member is pivotally and rotatably secured to the frame and arranged in opposing and rotatable contact with the first cylindrical member. The second cylindrical member is actuable in directions towards and away from the first member and such that, upon the hose being inserted between the first and second cylindrical members in a first displaced position, the cylindrical members are subsequently moved into contact with one another and the device translating upon a ground support surface so that the hose is drained and compressed into a collapsed condition.

13 Claims, 2 Drawing Sheets

WHEELED SQUEEGEE FOR FIRE HOSE

CROSS REFERENCE TO RELATED APPLICATIONS

The present application claims priority from U.S. Provisional Application Ser. No. 60/296,967, filed Jun. 8, 2001, and entitled "Squeegee for Fire Hose".

BACKGROUND OF THE INVENTION

1. Field of the Invention

The present invention relates generally to devices used to remove water from a fire hose after use and before the fire hose is stored, typically on a fire truck. More particularly, the present invention discloses a walk-along and wheeled squeegee device for evacuating fluid (such as water) from a fire hose after use and prior to storage of the hose in a compressed and typically rolled condition.

2. Description of the Prior Art

Fire hoses are typically formed of a flexible material such as plastic or fabric or combinations thereof, which may be collapsed for compact storage. After a fire hose is used, it must be evacuated of water to allow for compact storage.

In the past, and in order to achieve drainage of fire hoses, it has been known to form detachable couplings at regular intervals so that, upon detaching a section of fire hose, it is drained by elevating one end and allowing water to flow out of the other end. The hose sections must then be reattached at the coupling, thus necessitating a time-consuming procedure.

Attempts have been made in the prior art to facilitate the drainage of fire hoses and a first example of this is illustrated in U.S. Pat. No. 6,135,139, issued to Blake, Jr., which teaches the attachment of two disks at spaced locations to a cylindrical bar. The bar passes through a center of each disk and perpendicular to the plane of the disks. A hollow tube further surrounds the cylindrical bar between the two disks and rotates freely around the cylindrical bar in such a manner as to allow a flat hose to pass over the cylindrical bar and to thereby facilitate drainage of the hose.

Examples of combination winding and draining devices for fire hoses are further known and one example is illustrated in the hose winding apparatus shown in Dubreuil, U.S. Pat. No. 5,505,404, and which teaches a base member with an upwardly extending vertical support structure. A horizontal support structure extends frontwardly from the vertical support structure and includes manual reel having a crank handle for winding the hose. The reel is positioned on the distal end of the horizontal support structure and a pair of squeezing rollers are mounted on the vertical support structure. The squeezing rollers are adapted to squeeze the hose into a flat configuration as it is being wound upon the reel and a foot operated mechanism allows the user to temporarily separate the squeezing rollers so as to allow passage of the coupling components at both ends of the hose. It is further noted that the guiding rollers are movable relative to one another so as to allow adjustment to hoses having various diameters.

U.S. Pat. No. 4,265,414, issued to Spradling, teaches a collapsible hand operated and affixed apparatus for winding a length of fire hose of the type having male and female interlocking members on opposite ends. A support member is provided and upon which is mounted a horizontally disposed shaft having one end operatively connected to a hand crank which, when operated, rotatably drives a disk member carried at the opposite end of the shaft. Upon winding, the hose is concurrently drained and spirally wound about the disc member.

A further example of a draining and winding apparatus is illustrated in U.S. Pat. No. 5,388,609, issued to Ghio et al., and which discloses a hose reel cart with a vertically disposed and circular planar reel mounted at a slight incline to the vertical and upon a tubular wheeled cart. Tapered guide pins extend perpendicularly outwardly from one face of the reel and engage an end portion of a fire hose therebetween for removably securing the hose to the reel. A hand crank provides selective rotary drive to the reel via a chain and sprocket mechanism in order to flatten, drain and coil the hose in overlaying condition upon the reel. The tubular frame further includes a forwardly extending hose guide to assist in the aligning, flattening and draining steps as well as to serve as a ground engaging prop for supporting the cart.

Finally, U.S. Pat. No. 5,027,531, issued to Wiens, teaches an apparatus for drying hoses in a fire hall and which includes the provision of a rack having a plurality of shelves mounted upon a central support at a midpoint along the length of the shelves and mounting upon rollers at the outer ends. The central support is raised vertically upwardly along the wall and so that the ends move inwardly to a position at approximately a 45° angle thus bending the hoses at a central position into two inclined portions from which water can be drained.

SUMMARY OF THE PRESENT INVENTION

The present invention comprises a wheeled assembly for evacuating liquid, such as water, from a collapsible hose, typically further of the variety used by firefighters. The present invention is also an improvement over prior art water evacuation devices in that it provides a portable and wheeled assembly which can be transported to any on-site location and employed to quickly and effectively drain and compress individual sections of a fire hose prior to coiling and storage.

The assembly includes an elongated frame having a first and lower end and an angularly stepped configuration terminating in a second and upper end. A pair of spaced apart wheels are rotatably secured about an axis situated at the first end of the frame.

A first cylindrical member includes a first annular outer surface and is rotatably mounted about the axis between the pair of spaced apart wheels. A second cylindrical member is pivotally and rotatably secured to a further location of the frame and such that a second annular outer surface associated with the second cylindrical member is arranged in opposing and rotatable contact with the associated annular outer surface of the first cylindrical member.

In operation, the second cylindrical member is actuable between a first position in which it biasingly contacts the first cylindrical member and a second position in which it is displaced a selected distance from the first member. A first end of the hose, typically proximate in location to an associated end coupling, is inserted, from a sideways direction, and between the annular outer surfaces of the first and second cylindrical members in their displaced position. The annular outer surfaces are subsequently moved into contact with one another and the device translating upon a ground support surface, with the hose remaining substantially stationary, and so that the extending length hose is drained and compressed into a collapsed condition between the opposing annular surfaces of the rotatable members.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Referring now to FIGS. 1–5, a wheeled squeegee device is illustrated at 10 for evacuating liquid such as water from a collapsible hose. As previously explained, the present invention is an improvement over prior art water draining and compressing devices in that it provides a portable and wheeled assembly which can be transported to any on-site location and employed to quickly and effectively drain and compress individual sections of a fire hose prior to coiling and storage.

Figure 1:
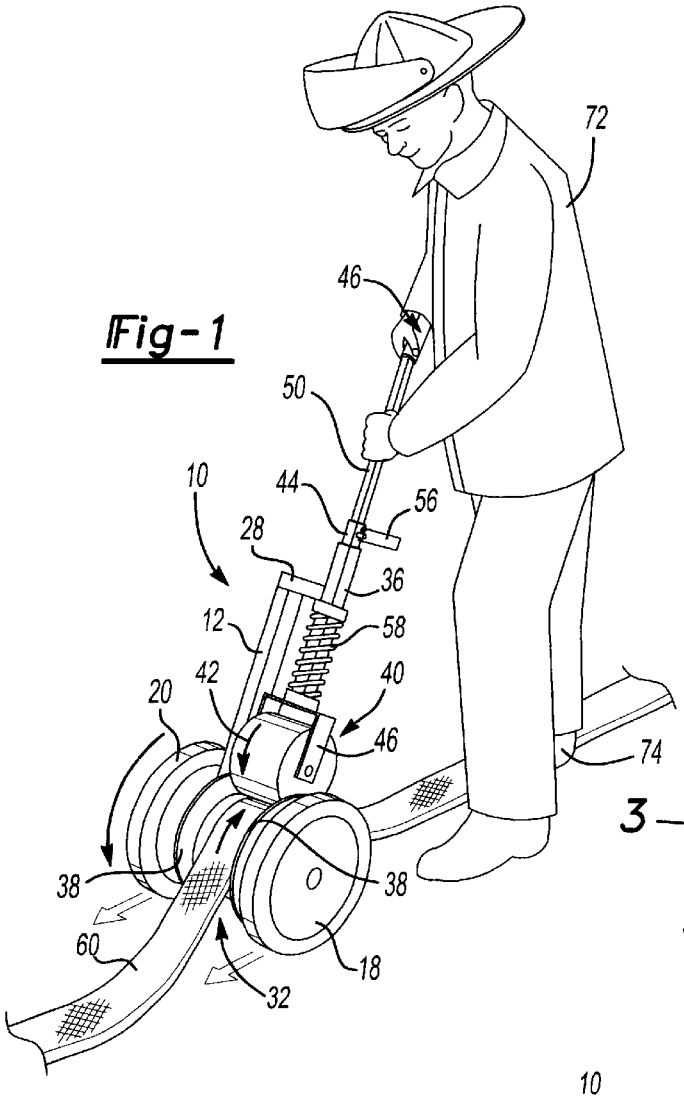
FIG. 1 is a perspective view of the wheeled squeegee device in use according to the present invention.
Figure 2:
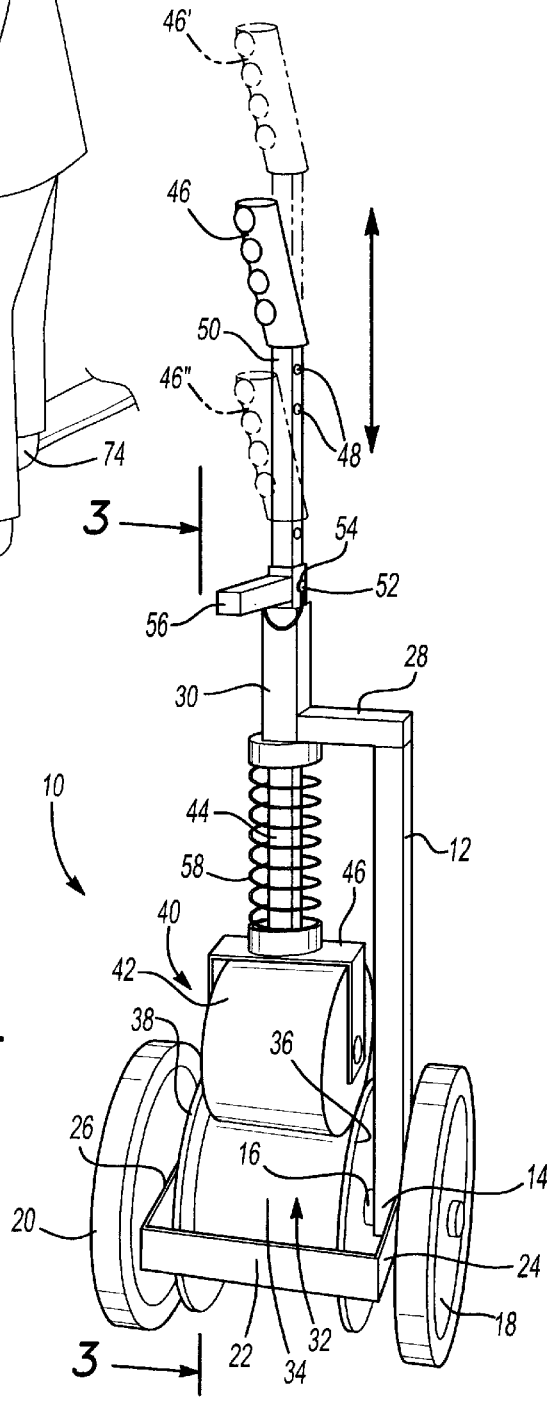
FIG. 2 is a further perspective view of the squeegee device as illustrated in FIG. 1 and further showing the telescoping nature of the upwardly extending handle relative to the elongated tubular member.
Figure 3:
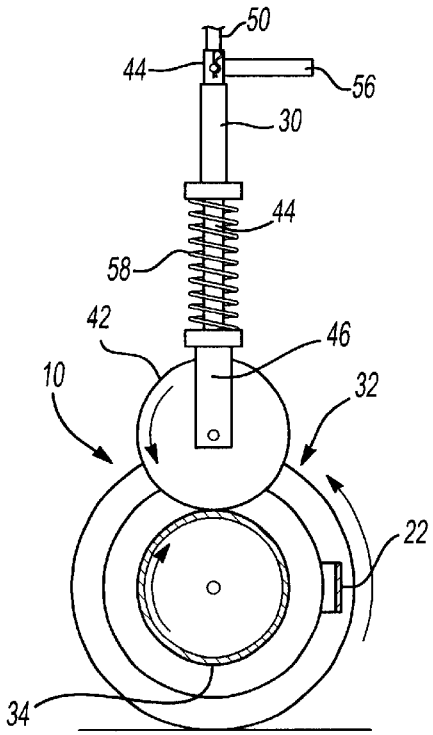
FIG. 3 is a side view illustration of the opposing and freely rotatable aspects of the first and second cylindrical members.

An elongated frame is illustrated at 12 in FIGS. 1 and 2 and is typically constructed of a durable material such as preferably a metal or even a heavy duty plastic. The frame 12 includes a lower end 14 (see FIG. 2) through which is rotatably channeled an axis 16. A pair of wheels 18 and 20 are arranged in spaced apart fashion at substantially opposite ends of the axis 16 and further such that the lower end 14 of the frame is located proximate the first selected wheel 18.

A substantially "U" shaped kick plate 22 (the purpose for which will be subsequently described) extends rearwardly from the frame and engages at locations 22 and 24 proximate the axis 16. Also, an upper end of the frame 12 includes a first substantially perpendicularly angled bracket 28 terminating in a sleeve portion 30 extending in parallel and spaced apart fashion relative to the main extending portion 12 of the frame.

A first cylindrical member, see generally at 32, is rotatably secured about the axis 16 and between the pair of wheels 18 and 20. The first cylindrical member 32 is further preferably secured in freely rotatable fashion about the axis 16, however it is understood that the rotatable member 32 may potentially be fixed to the axis 16 and still operable within the scope of the invention.

The cylindrical member 32 includes a first annular outer surface 34 as well as a pair of annularly projecting side flanges 36 and 38. A second cylindrical member 40 is provided and includes a second annular outer surface 42 which, in the arrangement of FIGS. 1–3 and 5, is located in opposing and abutting fashion against the annular outer surface 34 associated with the first cylindrical member 32. The cross sectional diameter of the second cylindrical member 40 is further illustrated as being smaller than that of the first cylindrical member 32, however the invention is understood as not being limited by any given ratio of size between the opposing member 32 and 40.

The manner of securing the second cylindrical member 40 includes the provision of an elongated tubular member 44, terminating at a lower extending end in a U-shaped bracket 46 within which is rotatably secured the second member 40. The tubular member 44 progressively extends upwardly in channeling fashion through the sleeve 30 and terminates at an opposite end in a handle 46 (see FIGS. 1 and 2).

In a preferred variant, the handle 46 is telescopically adjustable relative to the tubular member 44 and (referring specifically again to FIG. 2) this is accomplished through the provision of a plurality of spaced apart aperture 48 along an extending rod portion 50, which is telescopically seated within an upper end of the tubular member 44. A pin 52 seats through a selected one of the plurality of spaced apart apertures 48, as well as through a single additional aperture 54 located proximate the upper end of the tubular member 44. A gripping portion 56 extends from the upper end of the tubular member 44, in order to maintain it in upwardly projecting fashion from the sleeve 30, as well as to facilitate the adjustment of the handle 46 between axially adjustable positions such as illustrated by the handle in phantom at 46' and 46" shown in FIG. 2.

A coil spring 58 is provided and encircles the tubular member 44 in extending fashion between the second cylindrical member 40 and the sleeve 30. The spring 58 is illustrated in a first uncompressed position in FIGS. 1–3 and in which the exterior annular surface 42 of the second member 40 biasingly contacts the associated annular surface 34 of the first member 32.

Figure 4:
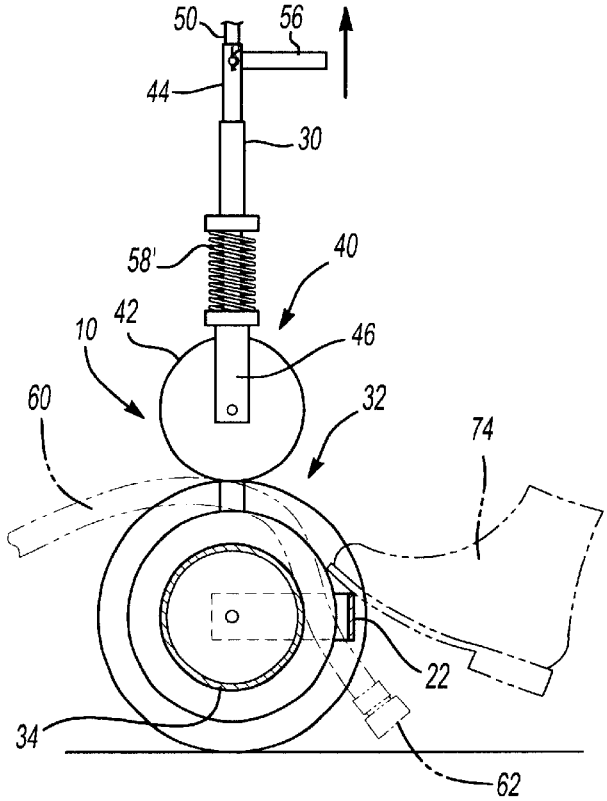
FIG. 4 is an illustration similar to that shown in FIG. 3 and showing an end of a hose inserted between the first and second cylindrical members.

Referring to FIG. 4, the gripping portion 56 is actuated upwardly, thereby lifting the tubular member 44 relative to the sleeve 30 and compressing the spring to the condition illustrated at 58'. At this point, an end of a hose 60 (typically proximate an interconnecting coupling end 62) is inserted between the opposing and now spaced apart annular surfaces 34 and 42 of the associated cylindrical members.

In the preferred variant, the hose 60 is inserted in a sideways direction opposite the side of the extending main frame 12 and given the absence of any obstructions on the side proximate the wheel 20. It is also however understood that alternate configurations of the wheeled squeegee device can be employed, and by which the hose is inserted from any direction between the opposing annular surfaces.

Figure 5:
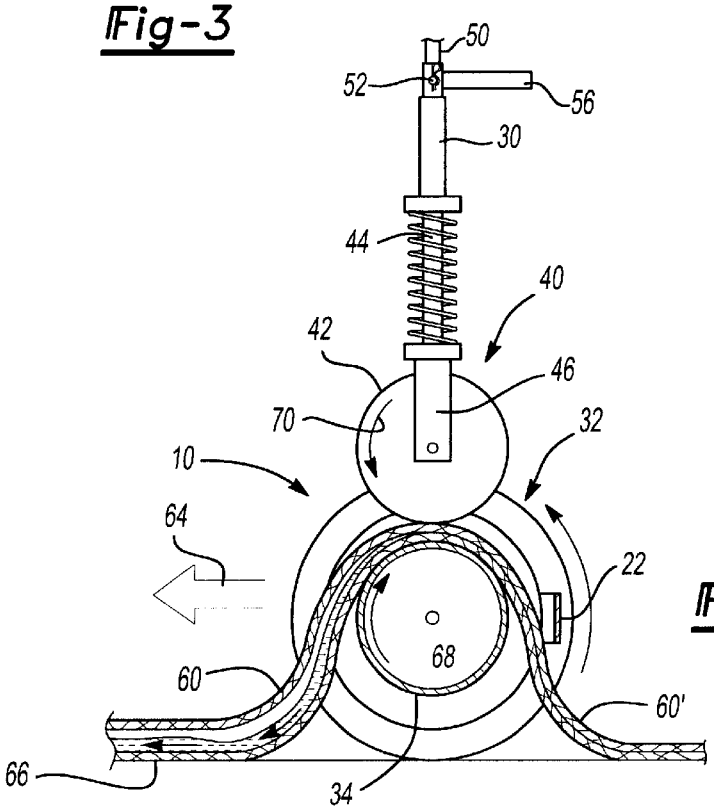
FIG. 5 is a yet further side view illustration and showing the progressive draining and collapsing of a fire hose by the wheeled squeegee device of the present invention.

Referring again to the perspective and side illustrations of FIGS. 1 and 5, respectively, the gripping portion 56 is released and the second cylindrical member 40 seats between the projecting side flanges 36 and 38 of the first member 32, following which its associated annular surface 42 is substantially compressed against the opposing annular surface 34 of the first cylindrical member 32. In this condition, the members are in a substantially biasingly contacting position and further in which the flexible and elongated hose 60 is compressingly engaging therebetween.

Upon translating the wheeled device 10 in a forward direction, see arrow 64 in FIG. 5, the hose 60 is successively compressed to a condition illustrated at 60' and in which fluid (water) is forced in a direction along directional arrow 66 and out of the hose 60. As is also illustrated, the freely interengaging and rotative aspects of the cylindrical members is such that the first member 32 rotates in a clockwise direction (see circular arrow 68), whereas the second member 40 rotates in an opposite and counterclockwise direction (see arrow 70).

As also seen in FIGS. 4 and 5, the trailing and compressed end 60' of the hose is ideally channeled to pass through an underside of the kick plate 22 and by which it is maintained along the ground surface. It is also contemplated that, within the scope of the invention, the user (see at 72 in FIG. 1) steps on compressed and trailing length of the hose 60 (see also users foot 74 in FIG. 4) in order to maintain the hose stationary along the ground surface and as the wheeled device translates the length of the hose.

As is well illustrated and described, use of this squeegee device 10 quickly evacuates a long section of hose and eliminates the need for disconnecting the hose at a coupling, elevating one section of the hose to drain, and then rejoining the two sections with the coupling.

In other embodiments of the invention, the structural details may vary but essentially include a pair of cylindrical members, or rollers, which are spring biased so as to have the opposing and annular surfaces come into contact with one another such that a length of hose may be inserted between the members/rollers and the rollers may be moved relative to the hose to evacuate the hose.

Having thus described my invention, additional preferred embodiments will become apparent to those skilled in the art to which it pertains, and without deviating from the scope of the appended claims.

I claim:

1. A device for evacuating liquid from an elongated and collapsible hose, said device comprising:

a frame;

a pair of spaced apart wheels rotatable about an axis situated at a first end of said frame;

a first cylindrical member having a first annular outer surface, said first member being rotatably mounted about said axis between said pair of spaced apart wheels;

a second cylindrical member pivotally and rotatably secured to a further location of said frame and such that a second annular outer surface associated with said second cylindrical member is arranged in opposing and rotatable contact with said annular outer surface of said first cylindrical member; and said second cylindrical member being actuable between a first position in which it biasingly contacts said first cylindrical member and a second position in which it is displaced a selected distance from said first member;

a first end of the hose being inserted from a sideways direction between said annular outer surfaces of said first and second cylindrical members in said displaced position;

whereby said annular outer surfaces subsequently moving into contact with one another and the device translating upon a ground support surface so that the hose remains substantially stationary while it is drained and compressed into a collapsed condition between said opposing annular surfaces.

2. The device as described in claim 1, further comprising an elongated tubular member extending through a sleeve defined at a second end of said frame, said second cylindrical member rotatably securing to an extending end of said tubular member.

3. The device as described in claim 2, further comprising a coil spring encircling said tubular member and extending between said second cylindrical member and said sleeve.

4. The device as described in claim 2, said elongated tubular member further comprising a handle extending from an end of said tubular member opposite said second cylindrical member.

5. The device as described in claim 4, further comprising said handle being telescopically adjustable relative to said tubular member.

6. The device as described in claim 1, further comprising a substantially "U" shaped kick plate extending rearwardly from said frame.

7. The device as described in claim 1, said frame having a specified shape and configuration and being constructed of a material including at least one of a metal and a heavy duty plastic.

8. The device as described in claim 1, further comprising said first cylindrical member being freely rotatable in a clockwise direction, said opposing and second cylindrical member being freely rotatable in an opposite and counter-clockwise direction.

9. The device as described in claim 1, said first cylindrical member further comprising a pair of annularly projecting side flanges and defining a circumferential channel for receiving said second cylindrical member.

10. A device for evacuating liquid from an elongated and collapsible hose, said device comprising:

a frame;

a pair of spaced apart wheels rotatable about an axis situated at an end of said frame;

a first cylindrical member mounted about said axis between said pair of spaced apart wheels;

a second cylindrical member pivotally and rotatably secured to said frame and arranged in opposing and rotatable contact with said first cylindrical member;

said second cylindrical member being actuable in directions towards and away from said first member; and the hose being inserted between said first and second cylindrical members in a first displaced position;

whereby said cylindrical members subsequently move into contact with one another and the device translated upon a ground support surface so that the hose remains substantially stationary while it is drained and compressed into a collapsed condition.

11. A device for evacuating liquid from an elongated and collapsible hose, said device comprising:

a frame;

a pair of spaced apart wheels rotatable about an axis situated at a first end of said frame;

a first cylindrical member having a first annular outer surface, said first member being rotatably mounted about said axis between said pair of spaced apart wheels;

a second cylindrical member pivotally and rotatably secured to a further location of said frame and such that a second annular outer surface associated with said second cylindrical member is arranged in opposing and rotatable contact with said annular outer surface of said first cylindrical member;

an elongated tubular member extending through a sleeve defined at a second end of said frame, said second cylindrical member rotatably securing to an extending end of said tubular member, said elongated tubular member further comprising a handle extending from an end of said tubular member opposite said second cylindrical member, said handle being telescopically adjustable relative to said tubular member; and said second cylindrical member being actuable between a first position in which it biasingly contacts said first cylindrical member and a second position in which it is displaced a selected distance from said first member;

a first end of the hose being inserted from a sideways direction between said annular outer surfaces of said first and second cylindrical members in said displaced position, said annular outer surfaces subsequently moving into contact with one another and the device translating upon a ground support surface so that the hose is drained and compressed into a collapsed condition between said opposing annular surfaces.

12. A device for evacuating liquid from an elongated and collapsible hose, said device comprising:

a frame;

a substantially "U" shaped kick plate extending rearwardly from said frame;

a pair of spaced apart wheels rotatable about an axis situated at a first end of said frame;

a first cylindrical member having a first annular outer surface, said first member being rotatably mounted about said axis between said pair of spaced apart wheels;

a second cylindrical member pivotally and rotatably secured to a further location of said frame and such that a second annular outer surface associated with said second cylindrical member is arranged in opposing and rotatable contact with said annular outer surface of said first cylindrical member; and said second cylindrical member being actuable between a first position in which it biasingly contacts said first cylindrical member and a second position in which it is displaced a selected distance from said first member;

a first end of the hose being inserted from a sideways direction between said annular outer surfaces of said first and second cylindrical members in said displaced position, said annular outer surfaces subsequently moving into contact with one another and the device translating upon a ground support surface so that the hose is drained and compressed into a collapsed condition between said opposing annular surfaces.

13. A device for evacuating liquid from an elongated and collapsible hose, said device comprising:

a frame;

a pair of spaced apart wheels rotatable about an axis situated at a first end of said frame;

a first cylindrical member having a first annular outer surface, said first member being rotatably mounted about said axis between said pair of spaced apart wheels;

a second cylindrical member pivotally and rotatably secured to a further location of said frame and such that a second annular outer surface associated with said second cylindrical member is arranged in opposing and rotatable contact with said annular outer surface of said first cylindrical member;

said first cylindrical member further comprising a pair of annularly projecting side flanges and defining a circumferential channel for receiving said second cylindrical member; and said second cylindrical member being actuable between a first position in which it biasingly contacts said first cylindrical member and a second position in which it is displaced a selected distance from said first member;

a first end of the hose being inserted from a sideways direction between said annular outer surfaces of said first and second cylindrical members in said displaced position, said annular outer surfaces subsequently moving into contact with one another and the device translating upon a ground support surface so that the hose is drained and compressed into a collapsed condition between said opposing annular surfaces.

* * * * *